US007797884B2

(12) United States Patent
Allen

(10) Patent No.: US 7,797,884 B2
(45) Date of Patent: Sep. 21, 2010

(54) FLEXIBLE FLASHINGS FOR WINDOWS, DOORS, AND THE LIKE

(75) Inventor: L. Ross Allen, 1201 Jericho La., Charlotte, NC (US) 28270

(73) Assignee: L. Ross Allen, Charlotte, NC (US)

( * ) Notice: Subject to any disclaimer, the term of this patent is extended or adjusted under 35 U.S.C. 154(b) by 124 days.

(21) Appl. No.: 12/037,470

(22) Filed: Feb. 26, 2008

(65) Prior Publication Data

US 2008/0141602 A1 Jun. 19, 2008

Related U.S. Application Data

(63) Continuation-in-part of application No. 11/026,664, filed on Dec. 31, 2004, now abandoned.

(51) Int. Cl.

| | |
|---|---|
| ***E04D 1/36*** | (2006.01) |
| ***E04D 13/00*** | (2006.01) |
| ***E06B 1/04*** | (2006.01) |
| ***E04C 2/38*** | (2006.01) |

(52) U.S. Cl. ..... 52/58; 52/97; 52/717.01; 52/717.03; 52/211

(58) Field of Classification Search ..... 52/58, 52/60, 97, 211, 204.53, 716.2, 717.01, 717.05, 52/717.03

See application file for complete search history.

(56) References Cited

U.S. PATENT DOCUMENTS

| | | | | |
|---|---|---|---|---|
| 1,677,130 | A | | 7/1928 | Cherry |
| 2,648,107 | A | | 8/1953 | Bates, Jr. |
| 2,697,932 | A | | 12/1954 | Goodwin |
| 3,008,273 | A | * | 11/1961 | Widin ..... 52/85 |
| 3,239,977 | A | | 3/1966 | Shore |
| 4,492,062 | A | | 1/1985 | Levenez |
| 4,555,882 | A | | 12/1985 | Moffitt et al. |
| 5,247,769 | A | * | 9/1993 | Becker ..... 52/506.06 |
| 5,377,464 | A | | 1/1995 | Mott et al. |
| 5,581,959 | A | * | 12/1996 | Occhipinti ..... 52/58 |
| 5,735,035 | A | * | 4/1998 | Holt ..... 29/527.2 |
| 5,921,038 | A | | 7/1999 | Burroughs et al. |
| 6,098,343 | A | | 8/2000 | Brown et al. |
| 6,293,064 | B1 | | 9/2001 | Larson |
| 6,305,130 | B1 | | 10/2001 | Ackerman, Jr. |
| 6,385,925 | B1 | | 5/2002 | Wark |
| 6,401,401 | B1 | | 6/2002 | Williams |
| 6,401,402 | B1 | | 6/2002 | Williams |

(Continued)

OTHER PUBLICATIONS

Lincoln Wood Products, Inc.,*Flanged Window Installation; instructions*; Mar. 2003; two pages.

(Continued)

*Primary Examiner*—Richard E Chilcot, Jr.
*Assistant Examiner*—Ryan D Kwiecinski
(74) *Attorney, Agent, or Firm*—Alston & Bird LLP

(57) ABSTRACT

A flexible flashing for sealing a window, door, or other portal against the entry of water. The flashing includes a base member with a plurality of channels that are structured to direct water therefrom, and a face plate extends from the base member and permits the flashing to be joined to a vertical wall. The face plate includes slots or corrugations which permit the flashing to be curved or flexed to correspond to a curved portion of the wall opening.

25 Claims, 3 Drawing Sheets

U.S. PATENT DOCUMENTS

| | | | | |
|---|---|---|---|---|
| 6,526,709 | B1 | 3/2003 | Jacobsen | |
| 6,901,707 | B2 * | 6/2005 | Smerud | 52/85 |
| 6,981,348 | B2 * | 1/2006 | Kjorsvik | 52/85 |
| 2004/0031210 | A1 * | 2/2004 | Kjorsvik | 52/58 |
| 2005/0055912 | A1 * | 3/2005 | Teodorovich | 52/261 |
| 2005/0166471 | A1 * | 8/2005 | Allen | 52/58 |
| 2005/0210768 | A1 * | 9/2005 | Lawson et al. | 52/97 |
| 2005/0217189 | A1 * | 10/2005 | Moffitt | 52/209 |
| 2006/0143994 | A1 * | 7/2006 | Allen | 52/58 |
| 2006/0156639 | A1 * | 7/2006 | Allen | 52/58 |
| 2006/0168902 | A1 * | 8/2006 | Allen | 52/204.1 |
| 2006/0230593 | A1 * | 10/2006 | Eggen et al. | 29/428 |

OTHER PUBLICATIONS

Andersen Corporation; Andersen® Windowalls®;*Perma-Shield®Double-Hung Windows*; PP/Product Presentation; p. 22 and 23.

* cited by examiner

FLEXIBLE FLASHINGS FOR WINDOWS, DOORS, AND THE LIKE

CROSS REFERENCE TO RELATED APPLICATION

This application is a continuation-in-part of U.S. application Ser. No. 11/026,664 filed Dec. 31, 2004, now abandoned which is hereby incorporated herein in its entirety by reference.

FIELD OF THE INVENTION

This invention relates to the installation of windows, doors, or other building members and, more particularly, relates to a flashing for directing water and preventing leakage of the water at a window or door.

BACKGROUND OF THE INVENTION

During a typical installation of a window in a building, a rough opening is first prepared in a wall of the building for receiving the window. The rough opening is defined by two jambs that extend vertically from a head at the top of the rough opening to a sill at the bottom of the opening. A weather resistant barrier material, such as a thin sheet of waterproof paper or plastic can be disposed over the outer surface of the wall, and the barrier material is cut at the rough opening and folded into the opening. The barrier material forms a moisture barrier extending over the outer surface, but due to the cuts in the barrier material does not normally provide a waterproof barrier on the inner surfaces of the rough opening. In particular, the barrier typically includes openings or cuts at the intersection of the jambs with each of the head and sill.

Flashings are often installed across the head and/or the sill, which extend outward from the head and sill onto a portion of the outer surface of the wall and upward from the sill onto a portion of each jamb. The flashings, which are formed of a flexible sheet of material, are cut and bent to correspond to the jambs, the outer wall surface, and the head or sill. Typically, two cuts are made in each of the head and sill flashing, each cut extending from a respective corner of the head or sill and the jambs, through the portion of the flashing that is disposed on the outer surface of the wall. Other cuts may be necessary depending on the configuration of the rough opening and the window. For example, if the rough opening has a curved head that corresponds to a semi-circular top portion of the window, the head flashing may be cut a number of times so that the flashing can be sufficiently bent to fit the curvature of the head.

In some cases, water can leak into the opening around or through the window or door. The water can sometimes penetrate both the barrier material and the flashings, e.g., through the cuts that are made in the barrier material and the flashing during installation. If the water flows into the wall, i.e., between the inner and outer surfaces of the wall, the water can damage to the wall and the window or door.

Thus, there exists a need for a product for use in a window or other portal installation for preventing the flow of water to the rough opening in the wall and to the inside of the wall. The product should be compatible with conventional windows and other portals and installation methods. In particular, the product should be compatible with windows of other portals with nonlinear sides, such as windows or doors with rounded or otherwise curved top or bottom portions. Preferably, the product should be relatively easy to install and economical to manufacture.

SUMMARY OF THE INVENTION

The above and other objects and advantages of the present invention are achieved by the provision of a flexible flashing for use in installing a portal, such as a window or door, in an opening in a wall. The flashing defines channels for directing water out of the wall to an outer or inner surface of the wall, thereby restricting the passage of water into the wall around the portal. For example, the flexible flashing can be used in connection with the installation of a window that has a curved frame, e.g., at the top and/or bottom of the window, that corresponds to a curved header and/or sill of the opening.

According to one embodiment of the present invention, the flexible flashing includes a base member that defines opposite first and second surfaces extending from a first edge to a second edge. The first surface of the base member includes a plurality of channels that are generally configured to direct water from the first edge to the second edge of the base member.

The flashing also includes a face plate that extends from the base member in a plane generally perpendicular to the base member such that a first edge of the face plate is proximate the base member and a second distal edge of the face plate extends therefrom. Thus, the face plate is structured to be disposed against the wall while the base member is disposed against the frame with the channels configured to direct water from between the frame and portal to the outer surface of the wall.

The face plate includes a plurality of slots or corrugations that extend from the second edge toward the first edge, e.g., partially along the height of the face plate, so that the base member can be flexed to the curved configuration of the frame. An end dam flange that is perpendicular to the base member and the face plate can be provided at one or both longitudinal ends of the flashing, and each end dam flange can be connected to the base member and the face plate to prevent water from flowing from the end of the flashing. Similar to the flashings described above, the flexible flashing can be formed of a unitary molded plastic member.

The channels in the first or upper surface of the base member are each defined by opposing side walls that diverge from each other in the direction toward the second edge of the base member such that each channel defines an increased width at the second edge. Also, in one preferred embodiment, the opposite side walls of each channel are undercut, so that when a portion of the flashing is disposed in a vertical direction in use, the lower side wall of each channel is able to capture any water and direct it downwardly and outwardly.

In some cases, the face plate extends from the first surface of the base member at the first edge of the base member so that the face plate can be disposed against the wall and the first surface of the base member can be disposed toward a curved head of the opening with the base member curved to the curved contour of the head. Alternatively, the face plate can extend from the second surface of the base member at the second edge of the base member so that the face plate can be disposed against the outer surface of the wall and the second surface of the base member can be disposed toward a curved sill of the opening with the base member curved to the curved contour of the sill.

The flashing can be composed of a plurality of segments which are disposed in an end-to-end arrangement with adjacent ends being releasably interconnected by integral connection means.

The present invention also provides an assembly in an opening of a wall, such as a window assembly, a shower door assembly, other portal assembly, or the like. The assembly includes a wall defining first and second opposite surfaces with an opening extending therebetween and a flexible flashing as described above and which can be configured to correspond to a curved portion of the opening. A window, door, other portal, or the like can be disposed in the opening.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
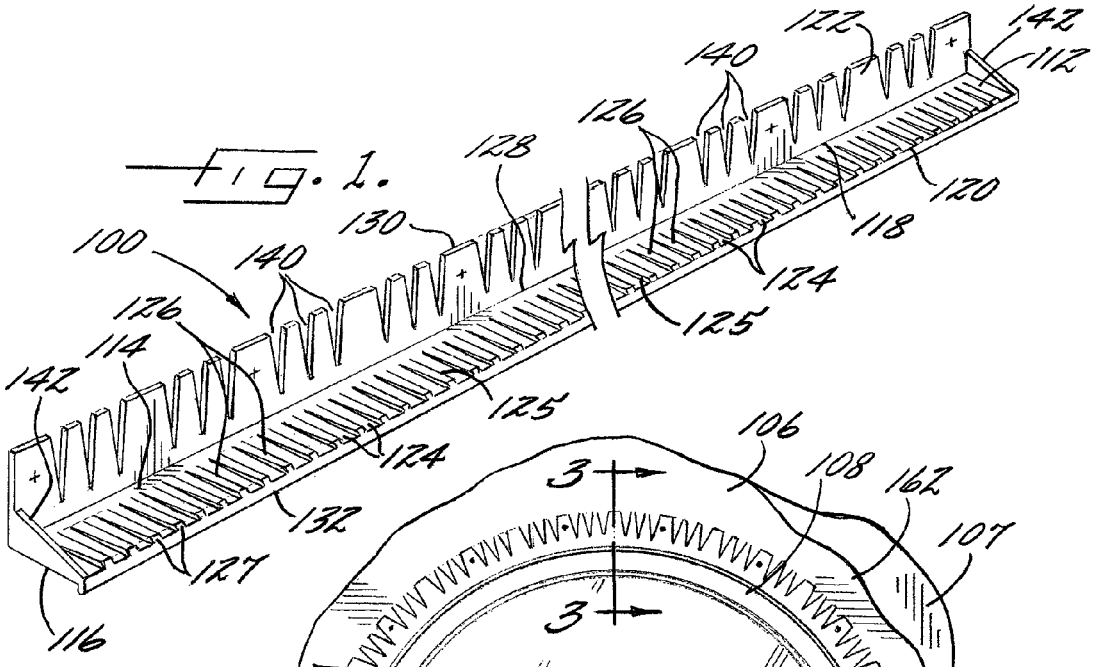
FIG. 1 is a perspective view illustrating a flexible flashing according to a first embodiment of the present invention.

Referring to the drawings and, in particular, to FIG. 1, there is shown a flexible flashing 100 according to one embodiment of the present invention. The flashing 100 is structured to be installed in a wall opening 104 in connection with the installation of a window 102 (FIG. 2) or other portal in the opening 104 so that the flashing 100 directs water out of the opening 104, e.g., to the outside of a building. Accordingly, the flashing 100 is preferably formed of a waterproof material. For example, the flashing 100 can be formed of a variety of materials including polymers, metals, and the like. In one advantageous embodiment of the invention, the flashing 100 is formed as a unitary member of plastic, such as polypropylene, polyethylene, polystyrene, or polyvinyl chloride (PVC). For example, the flashing 100 can be formed by a conventional injection molding operation using one or more dies that cooperably define a die cavity corresponding to the configuration of the flashing 100 so as to form the flashing as a unitary, molded plastic member.

Figure 2:
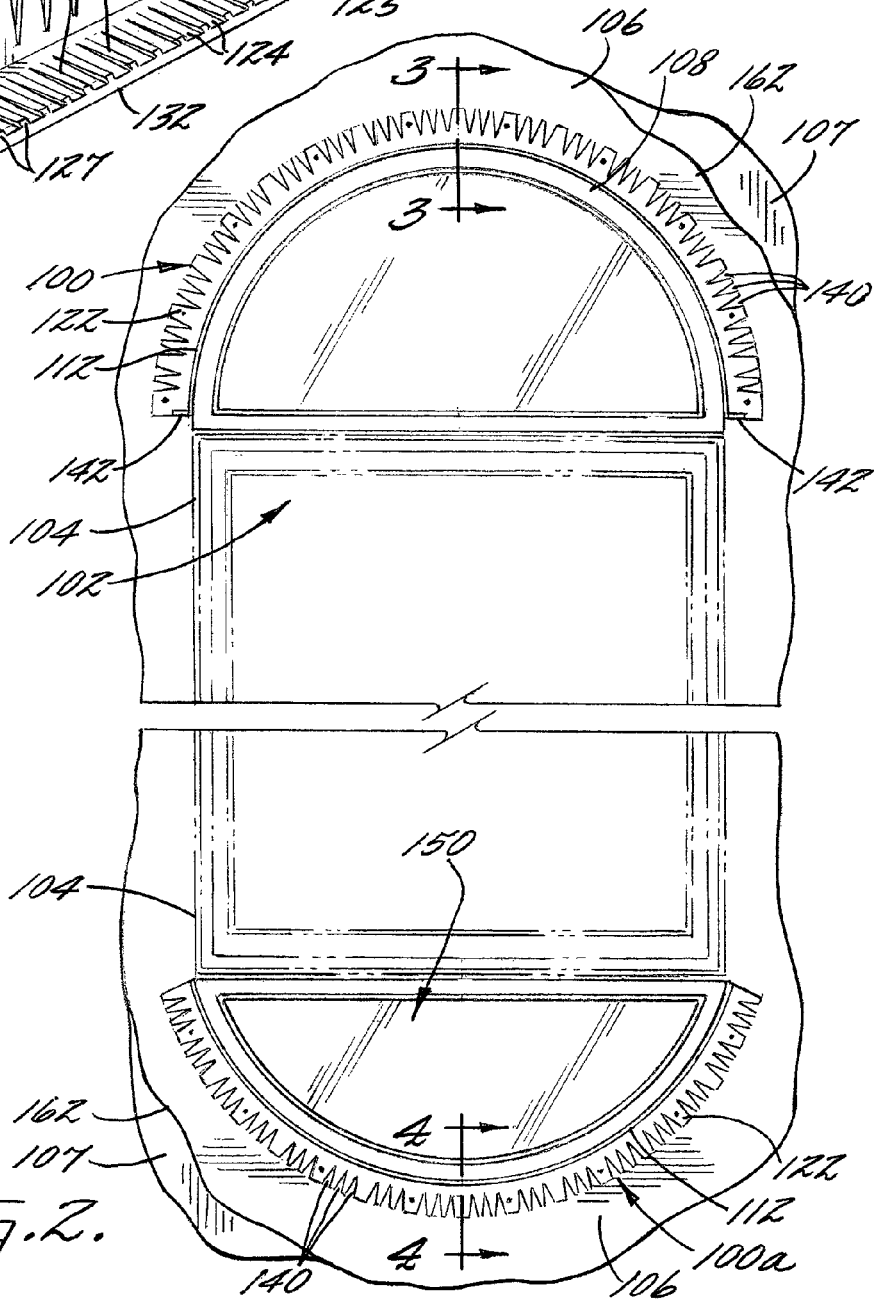
FIG. 2 is an elevation view illustrating a window assembly including a first flexible flashing similar to the one shown in FIG. 1 installed at the header of the opening in the wall and a second flexible flashing of the invention at the sill of the opening.

The flexible flashing 100 can be used, e.g., in connection with the installation of a window or other portal that defines a curved frame that corresponds to a curved opening in a wall. For example, as shown in FIG. 2, a window 102 is installed in an opening 104 in a wall 106. The window 102 defines a curved top portion 108 that corresponds to a curved header 110 of the opening 104. Flashings for use at the straight sides and corners of windows and other portals are further described in U.S. Pat. No. 7,059,087, issued Jun. 13, 2006, and U.S. patent application Ser. No. 11/026,820, filed Dec. 30, 2004, the entire contents of each of which is incorporated herein by reference, and the subject flashings of which can be used in combination with the flashings of the present invention.

As illustrated in FIG. 1, the flashing 100 includes a base member 112 and a face plate 122 that extends from the base member 112. The base member 112 defines opposite first and second surfaces 114, 116 that extend from a first edge 118 to a second edge 120. In one embodiment of the present invention, illustrated in FIG. 1, the face plate 122 extends from the first surface 114 of the base member 112 at the first edge 118 of the base member 112.

The first surface 114 of the base member 112 defines a plurality of channels 124 that are configured to direct water from the first edge 118 to the second edge 120 of the base member 112. For example, the channels 124 can be tapered to define a non-uniform depth and, in particular, a depth that increases between the first edge 118 and the second edge 120 so that water on the base member 112 tends to flow in that direction. The channels 124 can be defined between ridges 126, and the ridges 126 can together define a surface that is substantially parallel to the second surface 116 of the base member 112. The second surface 116 of the base member 112 is generally a smooth, continuous surface, i.e., a planar surface when the flashing 100 is in a straight configuration and a smoothly curved surface when the flashing 100 is bent.

Figure 3:
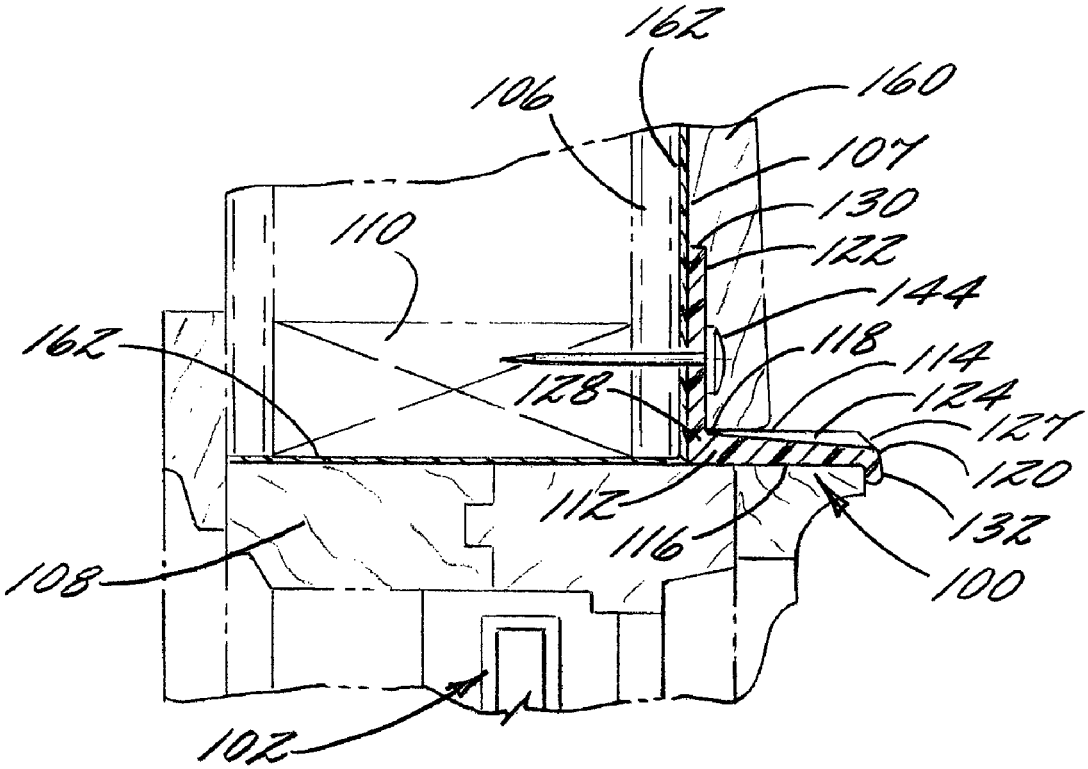
FIG. 3 is a section view illustrating the first flexible flashing of FIG. 2 as seen along line 3-3 of FIG. 2.

The face plate 122, which extends from a first edge 128 to a distal second edge 130, typically extends generally perpendicularly to the base member 112. Thus, as shown in FIG. 3, the face plate 122 can be disposed against the wall 106 while the base member 112 is disposed against the curved top portion 108 of the window 102 with the channels 124 configured to direct water outward from the outer surface 107 of the wall 106, i.e., over the second edge 120 of the base member 112, which can define a lip 132 or other extension.

Further, the face plate 122 defines a plurality of slots 140 that extend from the second edge 130 toward the first edge 128 of the face plate 122, thereby facilitating the bending or flexing of the flashing 100. That is, as the flashing 100 is bent about an axis parallel to the base member 112, the slots 140 are opened or closed accordingly. The slots 140 typically extend from the second edge 130 only partially through the face plate 122 toward the first edge 128. Thus, any water that is disposed on the first surface 114 of the base member 112 cannot easily leak through the slots 140. End dam flanges 142 can be provided at the longitudinal ends of the flashing 100. Each end dam flange 142 is connected to the base member 112 and the face plate 122 to prevent water from flowing from the end of the flashing 100.

Figure 4:
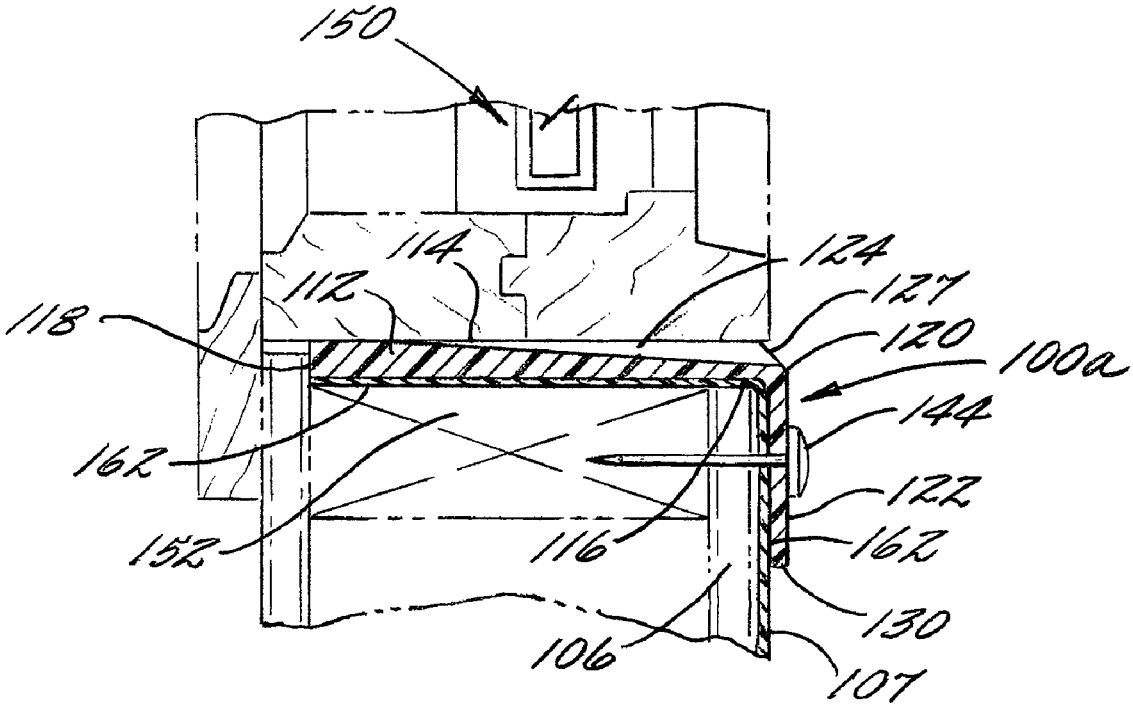
FIG. 4 is a section view illustrating the second flexible flashing of FIG. 2 as seen along line 4-4 of FIG. 2.

In another embodiment of the present invention, the flexible flashing is provided for use with a window or other portal that defines a curved bottom portion 150. In this regard, FIGS. 2 and 4 illustrate a flashing 100*a* that is disposed between the bottom 150 of the window 102 and a curved sill 152 of the opening 104 in the wall 106. Similar to the flashing 100 described above, the flashing 100*a* includes a base member 112 with channels 124, and a face plate 122 that extends from the base member 112 and defines slots 140 that permit the flexibility of the flashing 100*a*. However, in the embodiment of FIG. 4, the face plate 122 extends from the second surface 116 of the base member 112 at the second edge 120 of the base member 112, so that the face plate 122 can be disposed against the outer surface 107 of the wall 106 and the second surface 116 of the base member 112 can be disposed toward the curved sill 152 of the opening 104 with the base member 112 curved to correspond to the curved contour of the sill 152. Thus, the channels 124 of the flashing 100*a* are configured to direct water toward and through the face plate 122 and out of the wall 106.

The channels 124 of the flashings 100, 100*a* can be substantially parallel to each other and perpendicular to the face plate 122. Alternatively, in other embodiments of the invention, the channels 124 can be angled relative to the face plate 122. In either case, the channels 124 preferably do not extend through the first edge 118 of the base member 112. Further, as shown in FIGS. 2 and 4 and noted above, the channels 124 can be tapered in depth in a direction away from the first edge 118, i.e., such that each channel 124 defines an increased depth at the second edge 120. In some cases, each channel 124 can be deeper than the ridges 126 and/or the portion of the base member 112 between the first edge 118 and the channels 124, to further prevent the flow of water toward the first edge 118. Thus, water in the channels 124 generally flows toward the second edge 120 and exits the channels 124, i.e., away from the face plate 122 in the embodiment of FIGS. 1 and 3, and through the face plate 122 in the embodiment of FIG. 4.

The ridges 126 that separate the channels 124 define a support surface, which can be substantially planar and parallel to the opposite surface 116 of the base member 112. Thus, the flashings can be used for support, such as when the base member 112 of the flashing 100*a* is disposed between the wall opening 104 and the window 102 or other portal with the ridges 126 defining a support surface that is parallel to the sill 152 of the wall opening 104. The ridges 126 can be uniform in width or non-uniform in width, e.g., so that each ridge 126 is increasingly narrower in a direction away from the base member 112 to minimize the likelihood of water resting on the ridges 126. In addition, the height of each ridge 126 can be uniform or non-uniform along the length of each ridge 126. For example, each ridge 126 can define a decreased height nearest the second edge 120 so that the ridges 126 are less visually noticeable if the second edge 120 is exposed when installed.

Each of the channels 124 can be angled or tapered to direct water from the opening 104 in which the flashing 100, 100*a* is disposed. For example, each of the channels 124 can be defined by side walls 125 that are disposed at a non-perpendicular angle relative to the second edge 120 of the base member 112. The side walls 125 of each channel 124 can be parallel or nonparallel. For example, as shown in FIG. 1, the side walls 125 of each channel 124 diverge from each other in the direction toward the second edge 120. That is, each channel 124 is tapered to define an increased width at the second edge 120. The depth of the channel 124 also generally increases toward the second edge 120, so that water on the flashings 100, 100*a* tends to drain to the second edge 120. In this way, if a portion of the flashing 100, 100*a* is disposed in a non-horizontal orientation, as is the case for the longitudinal ends of both flashings 100, 100*a* in FIG. 2, the channels 124 of the non-horizontal portions tend to drain water by gravity toward the second edge 120 and out of the wall 106.

In addition, the base member 112 can define an angled portion at the second edge 120 to facilitate the entry of the window 102 or other portal into the opening 104 after the flashing(s) 100, 100*a* have been disposed therein. For example, each of the ridges 126 can define an angled lead-in edge 127 at the second edge 120, i.e., a surface that is disposed at about a 45° angle relative to the general plane of the base member 112 and the top surface of the ridges 126.

Typically, the flexible flashings 100, 100*a* are formed of a unitary molded plastic material, and the end dam flanges 142 and slots 140 are formed during the molding of the flashing 100, 100*a*. The flexible flashing 100, 100*a* can be formed in a straight or curved configuration, and typically can be bent after forming, such as in connection with the installation of the window 102 or other portal. Thus, a single flashing 100, 100*a* can be used for windows having various curved configurations. In addition, the flashing 100, 100*a* can be formed of a material with sufficient elasticity such that the flashing 100, 100*a* can be bent to its curved configuration for installation without plastically deforming the flashing 100, 100*a*. Further, the flashing 100, 100*a* can also be used for windows or other portals that are not curved. That is, the flashing 100, 100*a* can be installed in a substantially straight configuration when used in connection with the installation of a typical rectangular window. In that configuration, the base member 112 of the flashings 100, 100*a* can be disposed horizontally between the window 102 and either the header 110 or the sill 152.

Each flashing 100, 100*a* can be formed in various lengths, according to the size of the opening and the length of the curved portion of the opening 104. Further, the flashings 100, 100*a* can be readily cut or otherwise trimmed to size so that each flashing 100, 100*a* extends along a desired length of the perimeter of the opening 104. Thus, the flashing 100 can be disposed to extend about any angle or radius and at various curvatures. For example, if the flashing 100 is to be used with a window 102 having a top portion 108 that is curved through a 180° arc, as shown in FIG. 2, the flashing 100 can extend around the entire curved portion of the top 108 of the window 102. Alternatively, the flashing 100 can be disposed about only a portion of the arc defined by the window 102. Further, in some cases, more than one of the flashings 100 can be used in combination at the top or bottom of the window 102. For example, if the window 102 defines an arc that is longer than the length of the flashing 100, two or more of the flashings 100 can be disposed end-to-end so that the flashings 100 in combination extend about the desired portion of the window 102.

If multiple flashings 100, 100*a* are used in one installation assembly, an interface defined between the flashings 100, 100*a* can be covered or otherwise sealed with a sealant material, such as a strip of tape or other membrane or caulk. The interface can also be sealed using an additional flashing member such as an L-shaped flashing member that corresponds generally in cross-section to the base member 112 and face plate 122, which can be disposed on the ends of the multiple flashings 100, 100*a* to cover the interface therebetween.

Each flashing 100, 100*a* can be secured to the wall 106 or the window 102, e.g., using fasteners 144, such as nails, screws, or the like. Before or after the window 102 or other portal is disposed, siding materials 160 such as vinyl or aluminum siding strips, wood shingles, stucco, or bricks are typically disposed on the outer surface 107 of the wall 106. In addition, as is known in the art, the outer surface 107 of the wall 106 can be covered by a laminar sheet of a moisture barrier material 162, and the sheet 162 can be folded into the opening 104 before the window 102 and siding materials 160 are installed. According to the present invention, the second edge 120 of the flashings 100, 100*a* can be disposed outside the sheet 162 of barrier material, such that the flashing 100 drains water outside the wall 106, outside the barrier sheet 162, and inside or outside of the siding 160. Advantageously, the flashing 100, 100*a* can be made to cover any cuts or holes in the barrier sheet, such as cuts that are made to facilitate the folding of the sheet 162 into the opening 104 or cuts or holes resulting from wear.

FIGS. 5-9 show a further embodiment of the flashing at 200, and which is composed of several segments 200*a*, 200*b* disposed in an end-to-end arrangement, with adjacent ends being releasably interconnected by an integral coupling structure 250. The segments 200*a*, 200*b* are of like molded plastic construction, and each includes a base member 212 which defines a first or bottom surface 214 and an opposite second or upper surface 216. Also, the base member 212 defines a first or rearward edge 218 extending in the longitudinal direction of the segment, and a second or front edge 220, which is parallel to the first edge 218.

An integral face plate 222 extends upwardly from the first or rearward edge 218 of the base member, and the face plate includes a plurality of longitudinally spaced apart and vertical slots 240 which extend from the upper edge of the face plate 222 downwardly to a point spaced from the base member 212. The slots 240 permit the base member 212 to readily flex about a transverse axis in a manner comparable to that shown in the top portion of FIG. 2.

Figure 5:
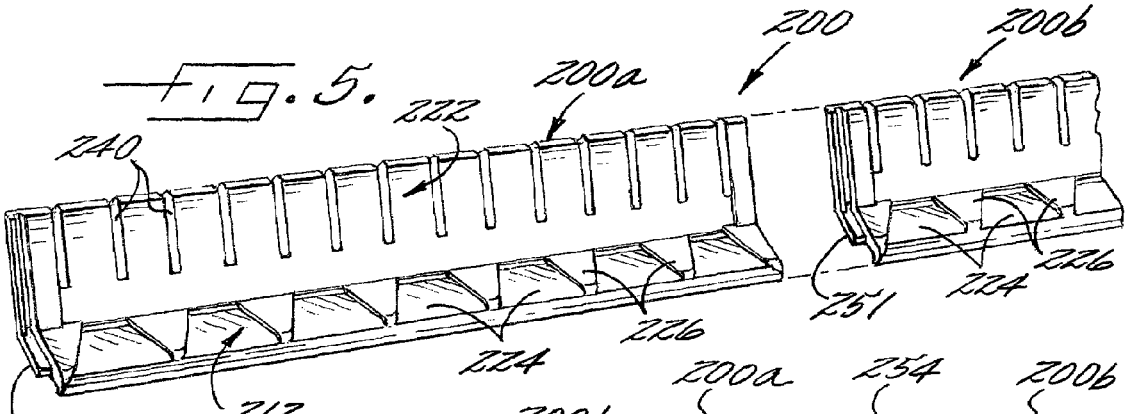
FIG. 5 is a perspective view of a further embodiment of the flashing of the invention and which is composed of several segments joined end-to-end.
Figure 7A:
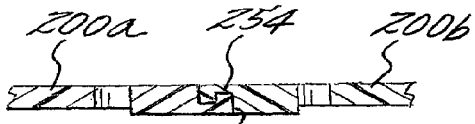
FIG. 7A is a sectional view taken along the line 7A-7A of FIG. 6.
Figure 6:
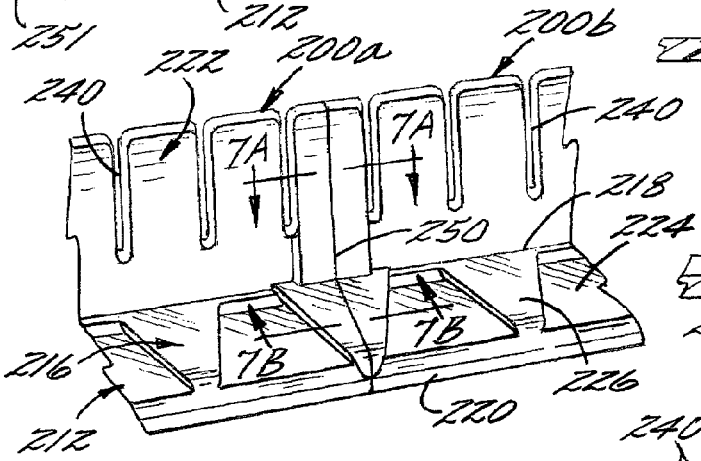
FIG. 6 is an enlarged fragmentary view of one of the segments shown in FIG. 5.
Figure 7B:
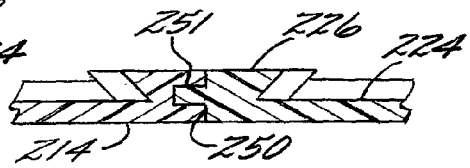
FIG. 7B is a sectional view taken along the line 7B-7B of FIG. 6.

As best seen in FIGS. 7A and 7B, the coupling structure 250 includes an integral tongue 251 along the left end of the base member of each segment as seen in FIG. 5, and the right end of each segment includes a groove (not numbered) which permits the adjacent tongue 251 to be slideably received therein, note FIG. 7B. Also, the adjacent face plates 222 include a cooperating pair of tongues 254 as seen in FIG. 7A. The tongues 254 engage each other when the tongue 251 is fully inserted in the groove so as to lock the two segments together. Clearly, other forms of an integral coupling structure could be designed by those skilled in the art.

The fact that the embodiment of FIGS. 5-9 is in the form of multiple segments, rather than a single long piece, greatly facilitates the shipping and handling of the flashing and permits it to be easily sized to fit a variety of opening sizes.

The upper surface 216 of the base member 212 includes a plurality of channels 224 that are configured to direct water from the rear edge 218 to the front edge 220 of the base member. For example, the channels 224 can be tapered to define a non-uniform depth, i.e., the base of the channels 224 can be non-parallel to the bottom surface 214 to define the desired taper, and so that any water in the channels drains to the front edge 220.

In the embodiment of FIGS. 5-9, the channels 224 are defined between ridges 226 of generally triangular outline in plan view, and with the ridges defining a surface which is generally planar and parallel to the bottom surface 214 of the base member.

Figure 8:
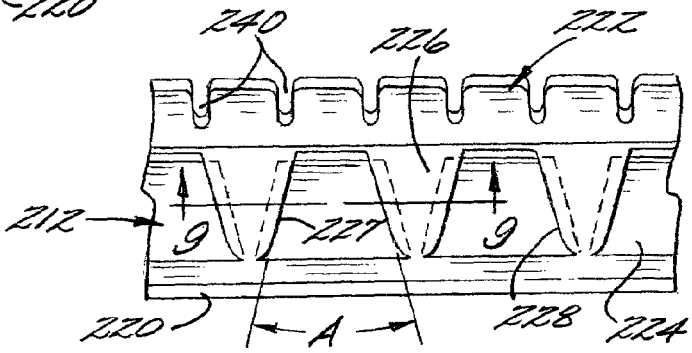
FIG. 8 is a top plan view of one of the segments shown in FIG. 5.
Figure 9:
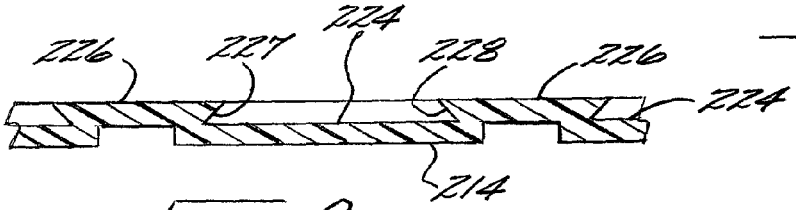
FIG. 9 is a sectional view taken along the line 9-9 of FIG. 8.

FIGS. 8 and 9 illustrate that the channels 224 have side walls 227, 228 which diverge from each other at a relatively wide angle A, such as about 30-45°. Also, each of the opposing side walls can be undercut as best seen in FIG. 9. The undercut, in conjunction with the diverging width of the channels, permits the lower side wall of each channel to capture any water and direct it downwardly and outwardly, in those portions of the flashing which are disposed in a generally vertical orientation, as is the case at the opposite end portions of the flashing as shown in FIG. 2.

Figure 10:
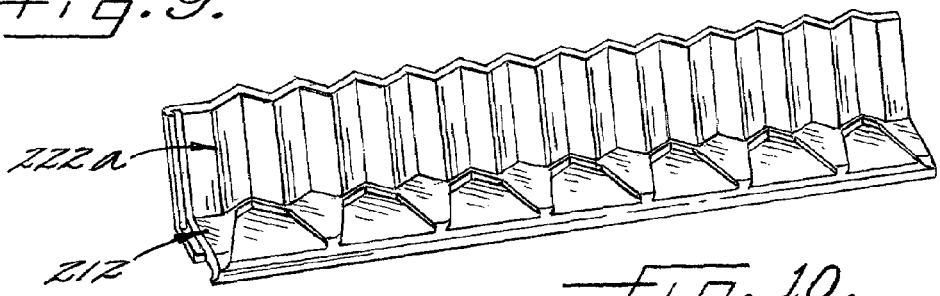
FIG. 10 is a perspective view of still another embodiment of the flashing of the invention.

FIG. 10 shows an alternative structure for the back wall of each segment of the flashing, which permits the elimination of the slots as shown in FIGS. 5-8. In particular, the face plate 222*a* in this embodiment incorporates a generally corrugated configuration which permits the base number 212 to be flexed in the manner described above.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A flexible flashing for use in a portal installation in a curved opening of a wall, the flashing comprising:

a base member defining opposite first and second surfaces extending from a first edge to a second edge, the first surface of the base member defining a plurality of channels configured to direct water in a direction from the first edge of the base member to the second edge of the base member; and a face plate extending from the base member in a plane generally perpendicular to the base member, the face plate defining a first edge proximate the base member and extending therefrom to a second distal edge, such that the face plate is structured to be disposed against an outer surface of the wall with the base member disposed against the curved opening of the wall and the channels configured to direct water on the base member outwardly from the wall, wherein the face plate includes a plurality of slots or corrugations extending in a direction from the second distal edge of the face plate toward the first edge of the face plate such that the base member can be flexed to the curved configuration of the opening, and wherein each channel is defined by opposing side walls that diverge from each other in the direction toward the second edge of the base member such that each channel defines an increased width at the second edge, wherein the flashing defines opposite ends, and wherein at least a plurality of said channels adjacent at least one of said ends includes two side walls, with at least the side wall closest to the adjacent end being undercut so as to be able to capture water in the associated channel when the portion of the flashing containing the channels with the undercut side wall being disposed substantially in a vertical direction.

2. A flashing according to claim 1, further comprising at least one end dam flange extending substantially perpendicular to the base member and the face plate at a longitudinal end of the flashing, the end dam flange being connected to the base member and the face plate to thereby prevent water from flowing from the end of the flashing.

3. A flashing according to claim 1 wherein the second surface of the base member is a substantially continuous, smooth surface.

4. A flashing according to claim 1 wherein each channel is tapered to define an increased depth at the second edge of the base member.

5. A flashing according to claim 1 wherein the flashing is formed of a molded plastic material.

6. A flashing according to claim 1 wherein the first surface of the base member defines ridges between the channels, the ridges defining an upper surface substantially parallel to the second surface of the base member.

7. A flashing according to claim 1 wherein the face plate extends from the first surface of the base member at the first edge of the base member, such that the face plate is structured to be disposed against the outer surface of the wall with the second surface of the base member disposed toward a curved top portion of the opening with the base member curved to the curved contour of the top portion of the opening.

8. A flashing according to claim 1 wherein the face plate extends from the second surface of the base member at the second edge of the base member, such that the face plate is structured to be disposed against the outer surface of the wall with the second surface of the base member disposed toward a curved sill of the opening with the base member curved to the curved contour of the sill.

9. A flashing according to claim 1, wherein the flashing is composed of a plurality of segments disposed in an end-to-end arrangement, with adjacent ends being releasably interconnected by integral connection means.

10. A window or door assembly in an opening of a wall, the assembly comprising:

a wall defining an outer surface and a wall opening therethrough, the wall opening being at least partially defined by a curved header at the top of the opening;

at least one flashing disposed adjacent the curved header at the top of the opening, the flashing comprising:

a base member defining opposite first and second surfaces extending from a first edge to a second edge, the first surface of the base member defining a plurality of channels configured to direct water in a direction from the first edge to the second edge and thereby outward from the wall; and a face plate extending from the first edge of the base member in a plane generally perpendicular to the base member and extending from the first surface of the base member, the face plate defining a first edge proximate the base member and extending therefrom to a second distal edge, such that the face plate is disposed against the outer surface of the wall, wherein the face plate includes a plurality of slots or corrugations extending in a direction from the second distal edge toward the first edge of the face plate such that the base member can be flexed to the curved configuration of the header at the top of the opening, and wherein each of the channels defines a tapered width, the width of the channels being defined in a direction parallel to the base member and substantially parallel to the face plate, and wherein each channel is defined by opposing side walls that diverge from each other in the direction toward the second edge of the base member such that each channel defines an increased width at the second edge; and a window or door disposed in the wall opening, the window or door defining a curved top corresponding to the curved header at the top of the opening, with the face plate of the flashing joined to the outer surface of the wall adjacent the wall opening and with the base member being disposed against the curved top of the window or door such that the channels are structured to direct water away from the face plate and the outer surface of the wall, wherein each of the channels includes opposite side walls, with the side walls each being undercut so that the lower side wall is able to capture water in the associated channel when the flashing is disposed substantially in a vertical direction.

11. An assembly according to claim 10, wherein the flashing is composed of a plurality of segments disposed in an end-to-end arrangement, with adjacent ends being releasably interconnected by integral connection means.

12. An assembly according to claim 10, further comprising at least one end dam flange extending substantially perpendicular to the base member and the face plate at a longitudinal end of the flashing, the end dam flange being connected to the base member and the face plate to thereby prevent water from flowing from the end of the flashing.

13. An assembly according to claim 10 wherein the second surface of the base member is a substantially continuous, smooth surface.

14. An assembly according to claim 10 wherein each channel is tapered to define an increased depth at the second edge of the base member opposite the face plate.

15. An assembly according to claim 10 wherein the flashing is formed of a molded plastic material.

16. An assembly according to claim 10 wherein the first surface of the base member defines ridges between the channels, the ridges defining an upper surface substantially parallel to the second surface of the base member.

17. A flexible flashing for use in a portal installation in a curved opening of a wall, the flashing comprising:

a base member defining opposite first and second surfaces extending from a first edge to a second edge, the first surface of the base member defining a plurality of channels configured to direct water in a direction from the first edge of the base member to the second edge of the base member; and a face plate extending from the base member in a plane generally perpendicular to the base member, the face plate defining a first edge proximate the base member and extending therefrom to a second distal edge, such that the face plate is structured to be disposed against an outer surface of the wall with the base member disposed against the curved opening of the wall and the channels configured to direct water on the base member outwardly from the wall, wherein the face plate includes a plurality of slots or corrugations extending in a direction from the second distal edge of the face plate toward the first edge of the face plate such that the base member can be flexed to the curved configuration of the opening, and wherein each channel is defined by opposing side walls that diverge from each other in the direction toward the second edge of the base member such that each channel defines an increased width at the second edge, wherein the opposite side walls of each of the channels are each undercut so that the lower side wall is able to capture water in the associated channel when the flashing is disposed substantially in a vertical direction.

18. A flashing according to claim 17, further comprising at least one end dam flange extending substantially perpendicular to the base member and the face plate at a longitudinal end of the flashing, the end dam flange being connected to the base member and the face plate to thereby prevent water from flowing from the end of the flashing.

19. A flashing according to claim 17 wherein the second surface of the base member is a substantially continuous, smooth surface.

20. A flashing according to claim 17 wherein each channel is tapered to define an increased depth at the second edge of the base member.

21. A flashing according to claim 17 wherein the flashing is formed of a molded plastic material.

22. A flashing according to claim 17 wherein the first surface of the base member defines ridges between the channels, the ridges defining an upper surface substantially parallel to the second surface of the base member.

23. A flashing according to claim 17 wherein the face plate extends from the first surface of the base member at the first edge of the base member, such that the face plate is structured to be disposed against the outer surface of the wall with the second surface of the base member disposed toward a curved top portion of the opening with the base member curved to the curved contour of the top portion of the opening.

24. A flashing according to claim 17 wherein the face plate extends from the second surface of the base member at the second edge of the base member, such that the face plate is structured to be disposed against the outer surface of the wall with the second surface of the base member disposed toward a curved sill of the opening with the base member curved to the curved contour of the sill.

25. A flashing according to claim 17, wherein the flashing is composed of a plurality of segments disposed in an end-to-end arrangement, with adjacent ends being releasably interconnected by integral connection means.

* * * * *